US006598832B1

(12) United States Patent
Chang

(10) Patent No.: US 6,598,832 B1
(45) Date of Patent: Jul. 29, 2003

(54) KITE ASSEMBLY

(76) Inventor: Chin-Chuan Chang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/285,879

(22) Filed: Oct. 25, 2002

(51) Int. Cl.[7] ..... A63H 27/08; B64C 31/06

(52) U.S. Cl. ..... 244/153 R; 244/153 A; D21/445; D21/446

(58) Field of Search ..... 244/153 R, 153 A; D21/445, 446

(56) References Cited

U.S. PATENT DOCUMENTS 2,222,402 A * 11/1940 Carrasco ..... 244/153 A
3,296,617 A * 1/1967 Rogallo ..... 342/8
4,076,190 A * 2/1978 Lois ..... 244/153 R
5,183,224 A * 2/1993 Harburg ..... 244/155 R
6,315,246 B1 * 11/2001 Wu et al. ..... 244/153 R

* cited by examiner

*Primary Examiner*—J. Woodrow Eldred

(57) ABSTRACT

A kite assembly has a first kite, a second kite, a rotating blade, a main shaft, a plurality of spine rods, a plurality of first crosspiece rods, and a plurality of second crosspiece rods. The first crosspiece rods are disposed in the first kite. The second crosspiece rods are disposed in the second kite. The main shaft has a lower joint connected to the first crosspiece rods and an upper joint connected to the second crosspiece rods. A ring is disposed on the rotating blade to receive the main shaft.

5 Claims, 9 Drawing Sheets

KITE ASSEMBLY

BACKGROUND OF THE INVENTION

The present invention relates to a kite. More particularly, the present invention relates to a kite assembly which is easily detached.

A conventional kite has a spine adhered on a cover sheet. A tail band is connected to the spine. However, the conventional kite cannot be detached.

SUMMARY OF THE INVENTION

An object of the present invention is to provide a kite assembly which has a three dimensional configuration while the kite assembly is flying.

Another object of the present invention is to provide a kite assembly which is easily detached.

Accordingly, a kite assembly comprises a first kite, a second kite, a rotating blade, a main shaft, a plurality of spine rods, a plurality of first crosspiece rods, and a plurality of second crosspiece rods. The first crosspiece rods are disposed in the first kite. The second crosspiece rods are disposed in the second kite. The main shaft has a lower joint connected to the first crosspiece rods and an upper joint connected to the second crosspiece rods. A ring is disposed on the rotating blade to receive the main shaft. Each of the spine rods has a plurality of sockets.

DETAILED DESCRIPTION OF THE INVENTION

Figure 1:
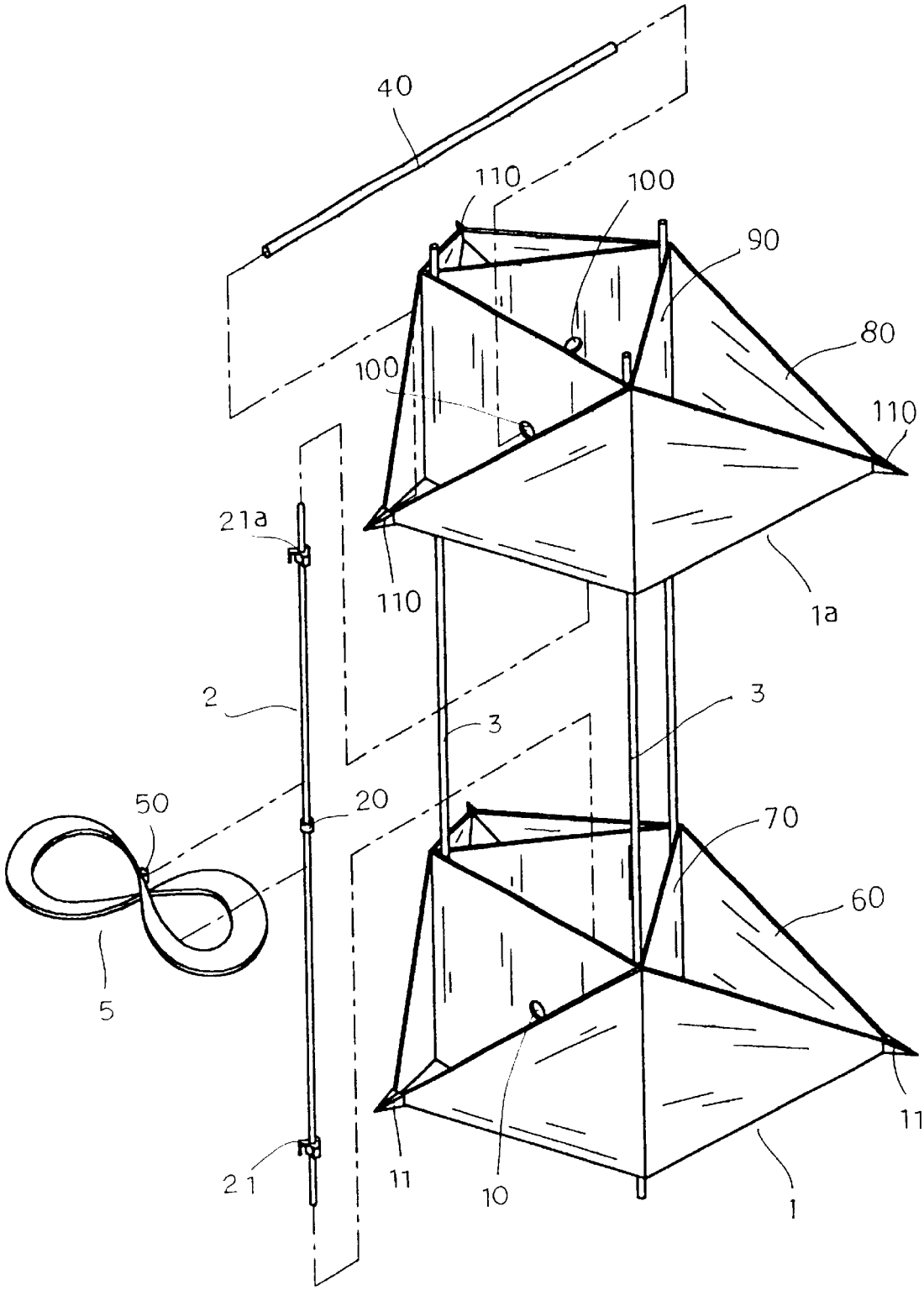
FIG. 1 is a partially perspective exploded view of a kite assembly of a preferred embodiment in accordance with the present invention.
Figure 2:
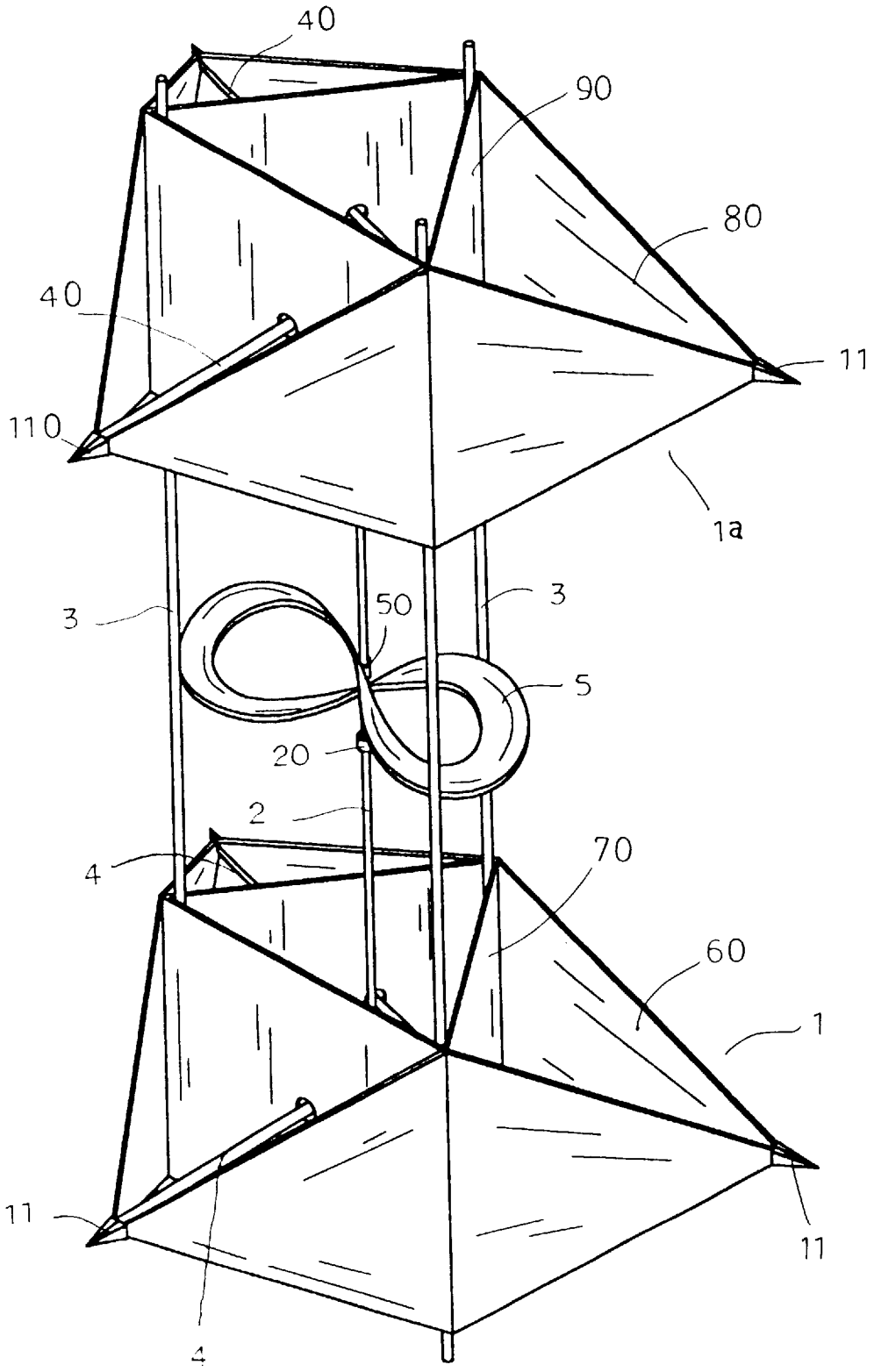
FIG. 2 is a perspective assembly view of a kite assembly of a preferred embodiment in accordance with the present invention.
Figure 3:
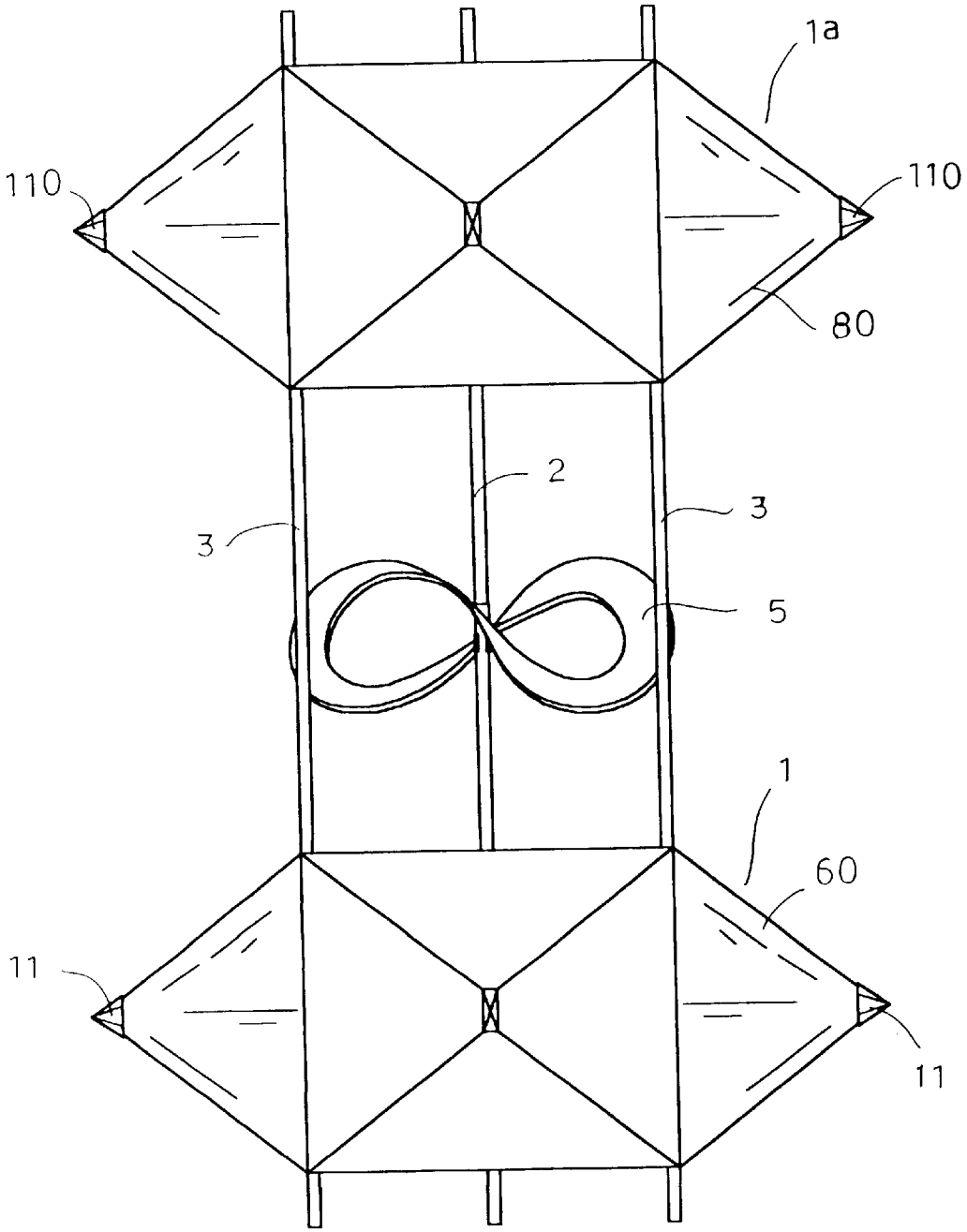
FIG. 3 is an elevational view of a kite assembly of a preferred embodiment in accordance with the present invention.
Figure 4:
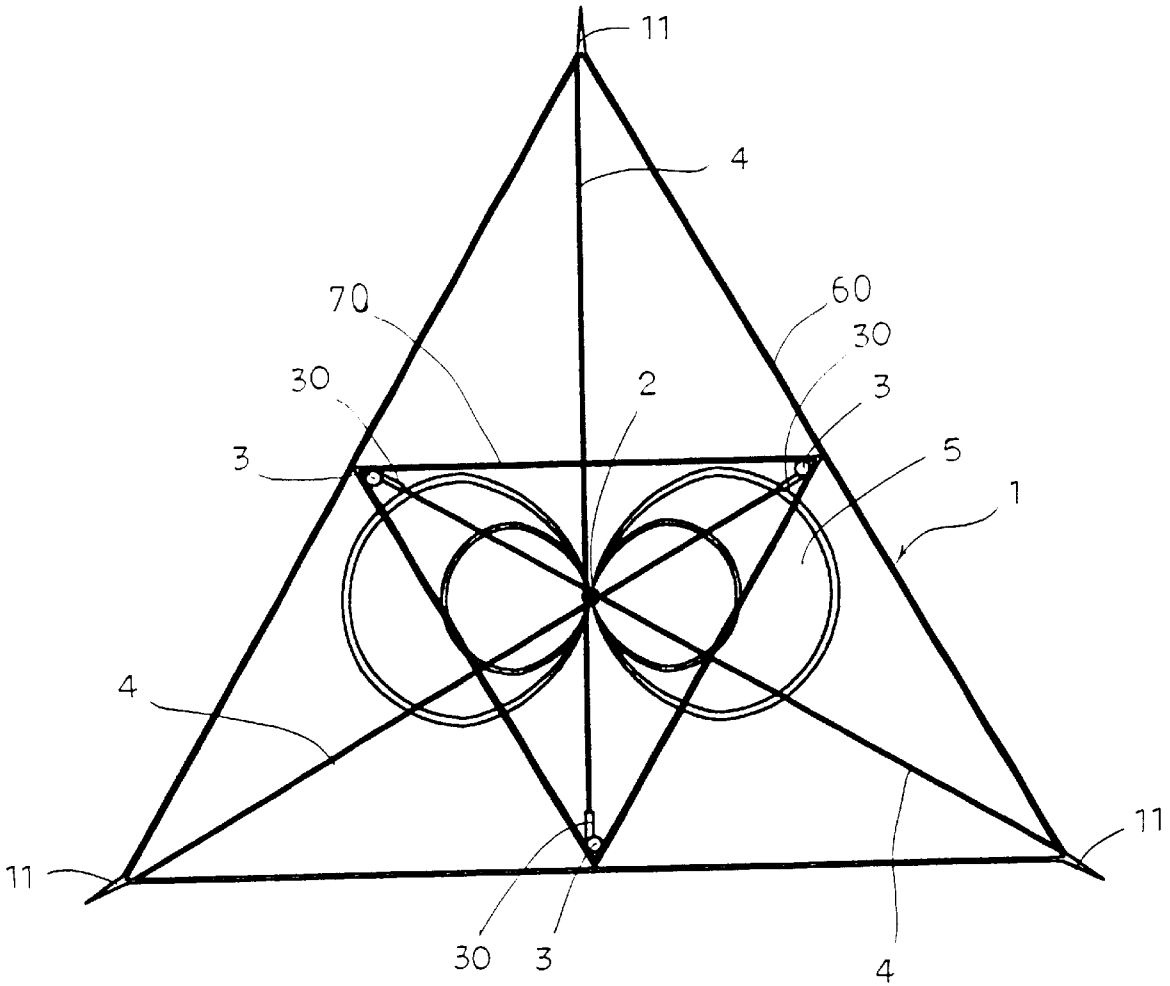
FIG. 4 is a bottom plan view of a kite assembly of a preferred embodiment in accordance with the present invention.
Figure 5:
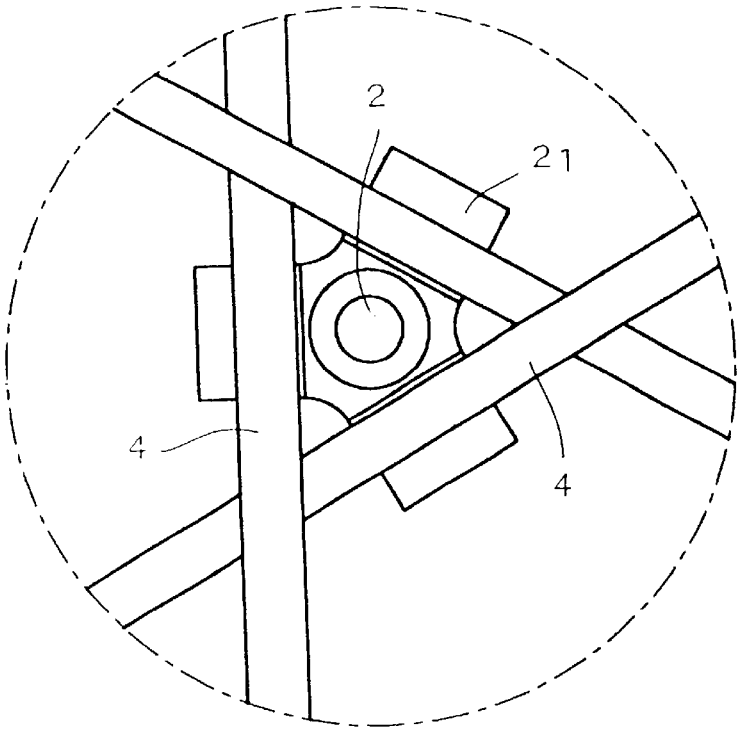
FIG. 5 is a schematic view illustrating a lower joint engaging with three crosspiece rods of a preferred embodiment in accordance with the present invention.
Figure 6:
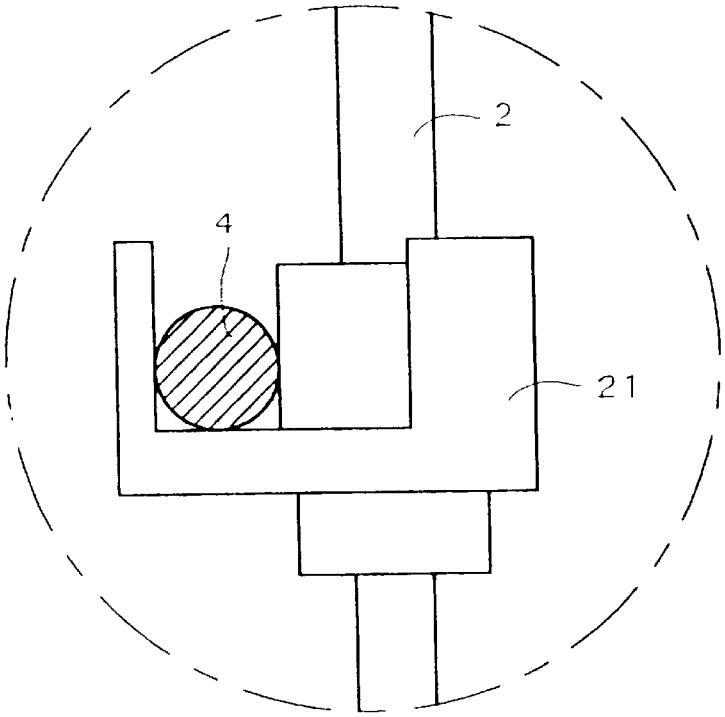
FIG. 6 is a schematic view illustrating a lower joint engaging with a crosspiece rod of a preferred embodiment in accordance with the present invention.
Figure 7:
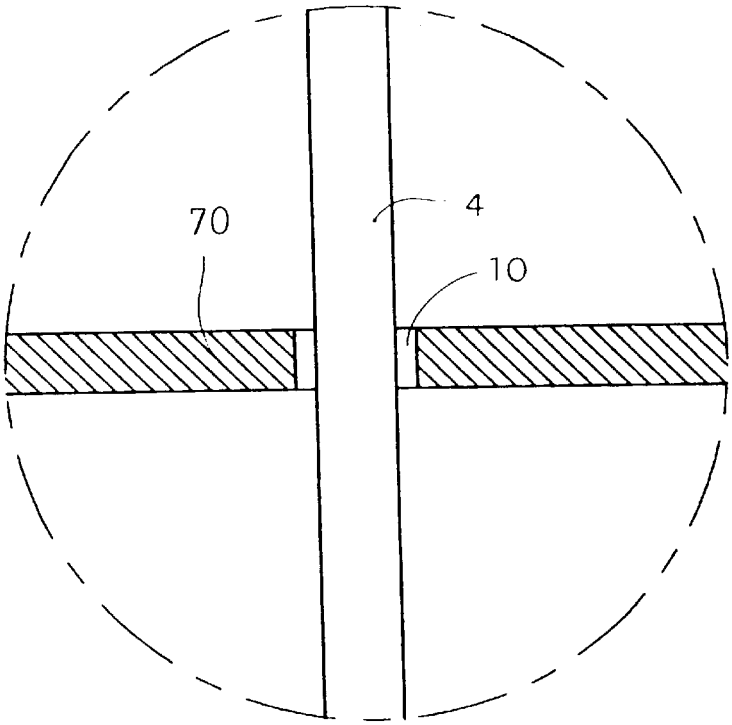
FIG. 7 is a schematic view illustrating a crosspiece rod passing through a round hole of a first inner fabric sheet of a preferred embodiment in accordance with the present invention.
Figure 8:
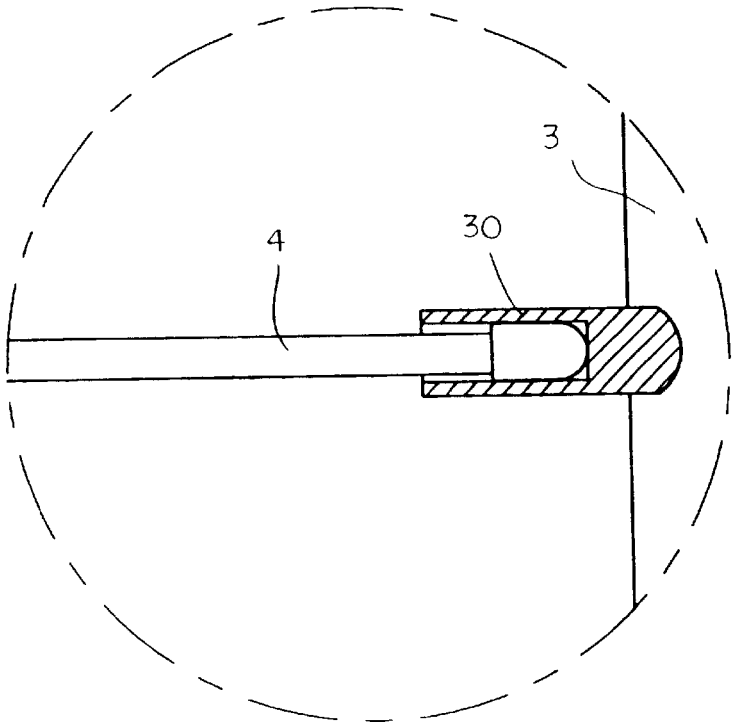
FIG. 8 is a schematic view illustrating a crosspiece rod engaging with a socket of a preferred embodiment in accordance with the present invention.
Figure 9A:
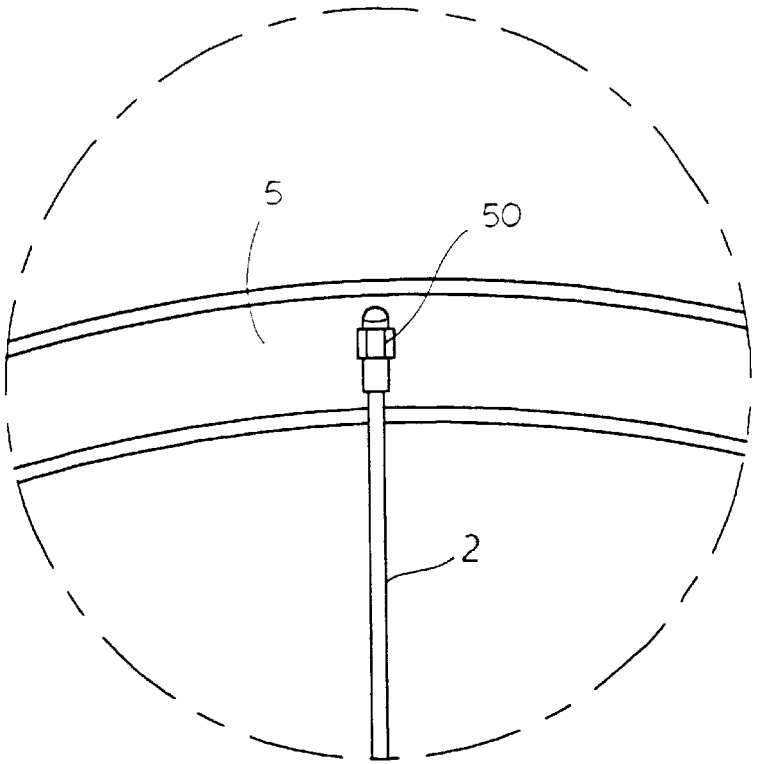
FIG. 9A is a schematic view illustrating a ring engaging with a main shaft of a preferred embodiment in accordance with the present invention.
Figure 9:
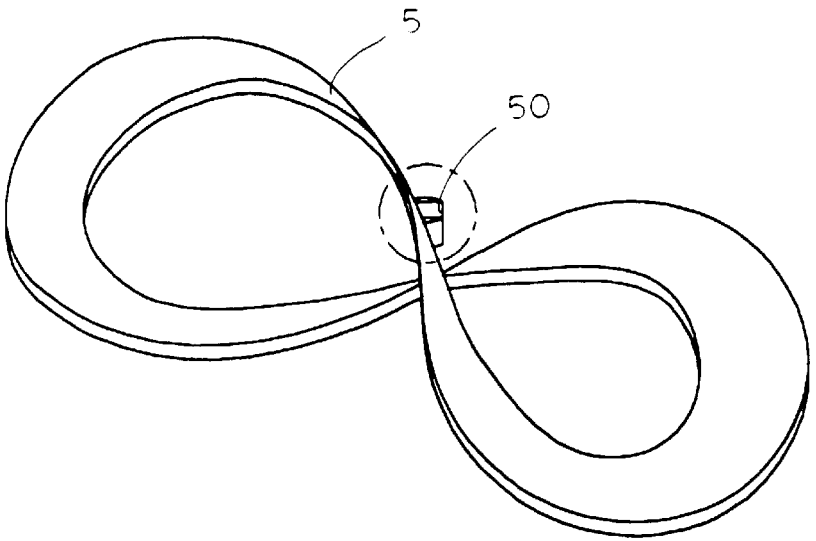
FIG. 9 is a perspective view of a rotating blade of a preferred embodiment in accordance with the present invention.

Referring to FIGS. 1 to 9, a kite assembly comprises a first kite 1, a second kite la, a rotating blade 5, a main shaft 2, a plurality of spine rods 3, a plurality of first crosspiece rods 4, and a plurality of second crosspiece rods 40.

The first crosspiece rods 4 are disposed in the first kite 1.

The second crosspiece rods 40 are disposed in the second kite 1*a*.

The main shaft 2 has a lower joint 21 connected to the first crosspiece rods 4 and an upper joint 21*a* connected to the second crosspiece rods 40.

A ring 50 is disposed on the rotating blade 5 to receive the main shaft 2.

Each of the spine rods 3 has a plurality of sockets 30.

A collar 20 surrounds a middle portion of the main shaft 2 to block the ring 50.

The first kite 1 has a plurality of first outer fabric sheets 60, a plurality of first inner fabric sheets 70, and a plurality of first corner seats 11.

Each of the first inner fabric sheets 70 has a round hole 10 to receive the corresponding first crosspiece rods 4.

Each of the first crosspiece rods 4 is connected to the corresponding socket 30 and the corresponding first corner seat 11.

The second kite 1*a* has a plurality of second outer fabric sheets 80, a plurality of second inner fabric sheets 90, and a plurality of second corner seats 110.

Each of the second inner fabric sheets 90 has a circular hole 100 to receive the corresponding second crosspiece rods 40.

Each of the second crosspiece rods 40 is connected to the corresponding socket 30 and the corresponding second corner seat 110.

The rotating blade 5 has an 8 shape.

Figure 10:
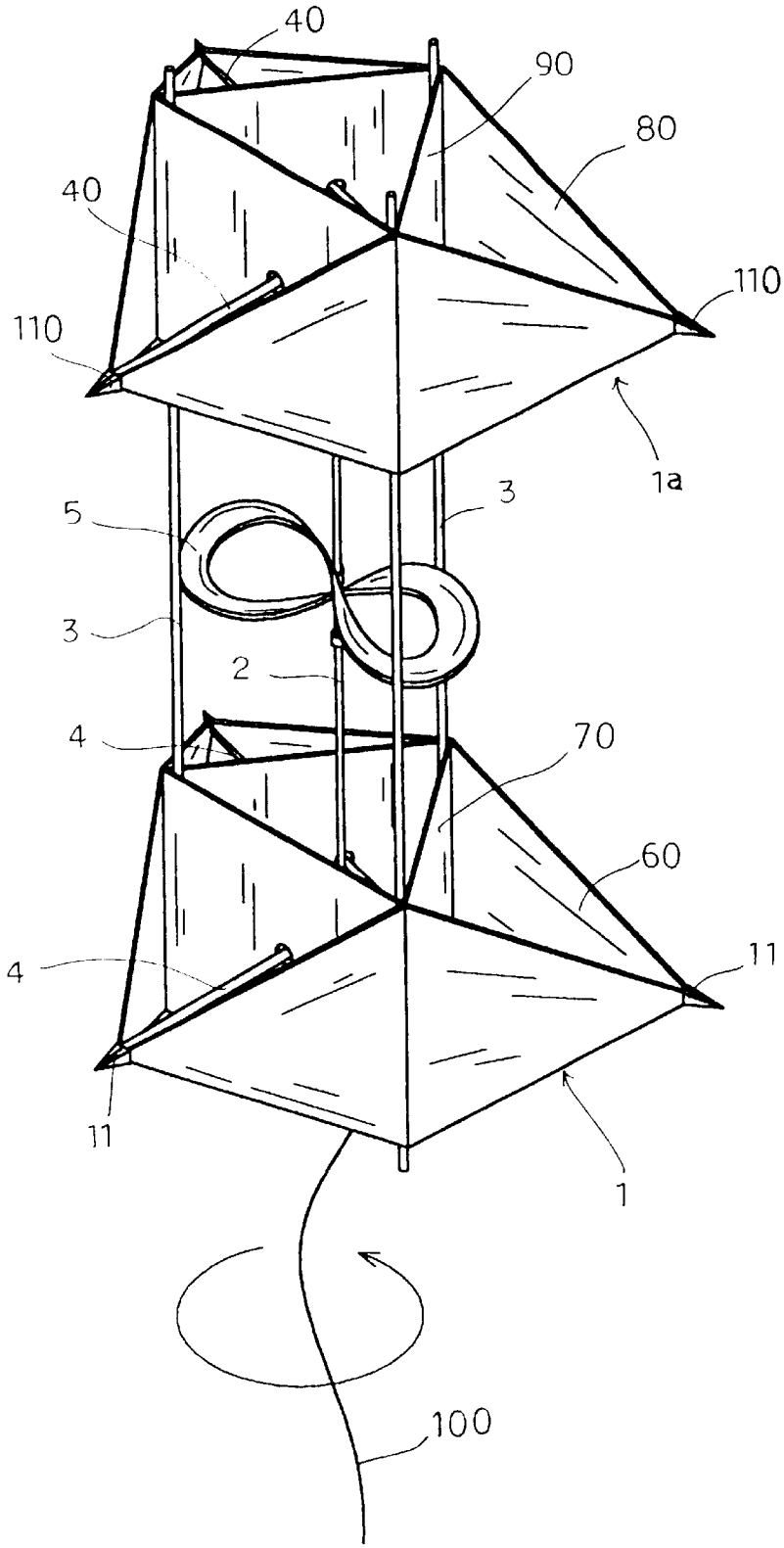
FIG. 10 is a schematic view illustrating a flying line connected to a kite assembly of a preferred embodiment in accordance with the present invention.

Referring to FIG. 10, a flying line 100 is connected to the kite assembly in order to control the kite assembly.

Figure 11:
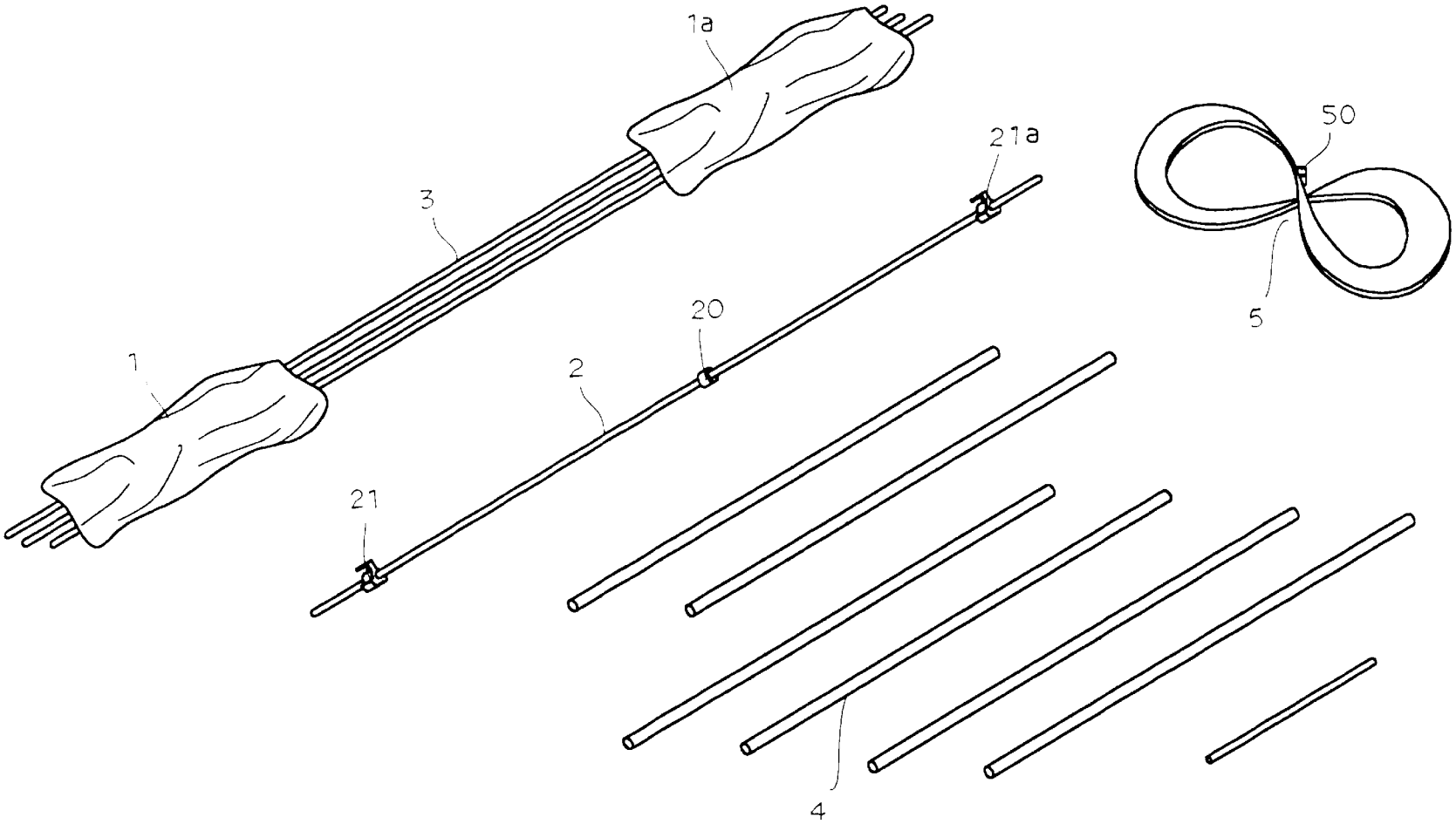
FIG. 11 is a schematic view illustrating a kite assembly of a preferred embodiment being detached.

Referring to FIG. 11, the kite assembly is detached.

The present invention has the following advantages. The kite assembly has a three dimensional configuration while the kite assembly is flying, and the kite assembly is easily detached.

The present invention is not limited to the above embodiments but various modification thereof may be made. Furthermore, various changes in form and detail may be made without departing from the scope of the present invention.

I claim:

1. A kite assembly comprises:

a first kite, a second kite, a rotating blade, a main shaft, a plurality of spine rods, a plurality of first crosspiece rods, and a plurality of second crosspiece rods, the first crosspiece rods disposed in the first kite, the second crosspiece rods disposed in the second kite, the main shaft having a lower joint connected to the first crosspiece rods and an upper joint connected to the second crosspiece rods, a ring disposed on the rotating blade to receive the main shaft, and each of the spine rods having a plurality of sockets thereon.

2. The kite assembly as claimed in claim 1, wherein a collar surrounds a middle portion of the main shaft to block the ring.

3. The kite assembly as claimed in claim 1, wherein the first kite has a plurality of first outer fabric sheets, a plurality of first inner fabric sheets and a plurality of first corner seats, each of the first inner fabric sheets has a round hole to receive the corresponding first crosspiece rods, and each of the first crosspiece rods is connected to the corresponding socket and the corresponding first corner seat.

4. The kite assembly as claimed in claim 1, wherein the second kite has a plurality of second outer fabric sheets, a plurality of second inner fabric sheets and a plurality of second corner seats, each of the second inner fabric sheets has a circular hole to receive the corresponding second crosspiece rods, and each of the second crosspiece rods is connected to the corresponding socket and the corresponding second corner seat.

5. The kite assembly as claimed in claim 1, wherein the rotating blade has an 8 shape.

* * * * *